US006487750B1

(12) United States Patent
Brown

(10) Patent No.: US 6,487,750 B1
(45) Date of Patent: Dec. 3, 2002

(54) HOSE CLEANING DEVICE

(76) Inventor: Terry A. Brown, P.O. Box 1211, Yuba City, CA (US) 95992

( * ) Notice: Subject to any disclaimer, the term of this patent is extended or adjusted under 35 U.S.C. 154(b) by 0 days.

(21) Appl. No.: 09/621,764

(22) Filed: Jul. 21, 2000

(51) Int. Cl.[7] ..... A47L 5/38

(52) U.S. Cl. ..... 15/302; 15/308; 15/309.1; 134/122 R

(58) Field of Search ..... 15/302, 308, 309.1; 134/66 R, 122 R

(56) References Cited

U.S. PATENT DOCUMENTS

| | | | | | |
|---|---|---|---|---|---|
| 415,935 | A | | 11/1889 | Boynton et al. | 134/199 |
| 425,642 | A | | 4/1890 | Villeneuve | 134/122 R |
| 2,651,312 | A | | 9/1953 | McBeth | 134/122 R |
| 3,530,526 | A | * | 9/1970 | Schmidt | 15/302 |
| 3,827,097 | A | | 8/1974 | Hamann | 15/40 |
| 3,916,925 | A | | 11/1975 | Crump | 134/172 |
| 4,206,526 | A | | 6/1980 | Bertram | 15/40 |
| 4,280,672 | A | | 7/1981 | Santos et al. | 15/40 |
| 4,391,016 | A | * | 7/1983 | Kawamura et al. | 15/302 |
| 4,502,175 | A | | 3/1985 | Hillis | 15/104.92 |
| 4,503,577 | A | | 3/1985 | Fowler | 15/88 |
| 4,591,390 | A | * | 5/1986 | Scott et al. | 15/302 |
| 4,723,564 | A | | 2/1988 | West et al. | 134/170 |
| 4,734,950 | A | | 4/1988 | Schenke et al. | 15/88 |
| 4,995,749 | A | | 2/1991 | Gornik | 15/1 |
| 5,040,259 | A | | 8/1991 | Ishii et al. | 15/40 |
| 5,056,185 | A | * | 10/1991 | Schotter | 15/302 |
| 5,109,565 | A | * | 5/1992 | Akin et al. | 15/309.1 |
| 5,113,884 | A | | 5/1992 | Melgeorge | 134/224 |
| 5,356,480 | A | | 10/1994 | Melgeorge | 134/15 |
| 5,566,415 | A | | 10/1996 | Wallace | 15/88.1 |
| 5,615,696 | A | | 4/1997 | Lawler | 134/104.2 |
| 5,634,236 | A | * | 6/1997 | Darsey | 15/309.1 |
| 6,003,194 | A | | 12/1999 | Eckroth | 15/302 |

* cited by examiner

*Primary Examiner*—Theresa T. Snider
(74) *Attorney, Agent, or Firm*—Heisler & Associates

(57) ABSTRACT

A device is provided for cleaning of elongate flexible hoses. The device has a smooth radiused low friction entry fairlead that allows the soiled hose to be readily pulled along a straight line path through the cleaner. After entry, the surface of the hose passes through a set of pliant wiping flaps that closely engage the full circumference of the hose, wiping dirt and debris from its surface as it enters the active cleaning region. In the cleaning region, multi-stream jets of high pressure water blast and scour the moving hose's surface, and the hose exits through a second set of pliant wiping flaps that wipe any adherent water from the hose surface. The active cleaning region, filled with water spray, is maintained at a negative pressure by means of an associated suction system which also sucks out the dirty water and debris. The pliant wiping flaps act as partial pneumatic seals, allowing maintenance of the negative pressure in the cleaning region. This negative pressure also urges water and dirt that may escape from the scouring region back into the low pressure evacuation region. The device is symmetrical with the cleaning region in the middle. Hence, the hose can pass through the device in either direction. The cleaned hose then leaves the cleaning device through a second smooth radiused low friction exit fairlead. The fairleads and wiping flaps are sufficiently non-resistant to hose travel therethrough that the device need not be anchored or provided with ballast to resist motion when the hose is moving through the device.

31 Claims, 4 Drawing Sheets

HOSE CLEANING DEVICE

FIELD OF THE INVENTION

This invention relates to flexible hose, and in particular to cleaning dirt and debris from a flexible hose's outer surface.

BACKGROUND OF THE INVENTION

The cleaning of debris and dirt from the surface of a flexible hose after use in an untidy environment has been a problem for which a solution has long been sought. Apparatus and methods utilizing various techniques are disclosed in patents dating back at least a century, and a comprehensive review of some of these patents describing the prior art is presented in U.S. Pat. No. 5,566,415. Generally, these patents disclose a variety of combinations and configurations of hose cleaning techniques, but none provides a completely satisfactory solution to cleaning the wide variety of hoses in commercial and fire-fighting use today. A satisfactory solution must take into consideration not only the proper cleaning of the hose surface, but convenience of use and the environmental impact of the disposal of dirt, debris and waste liquid produced in the process. The present invention provides a unit adapted for effective cleaning of a wide variety of hoses in an environmentally acceptable manner.

SUMMARY OF THE INVENTION

The hose cleaning device of this invention provides an enclosure through which the hose is passed for cleaning. Initially, the hose preferably passes through a smooth radiused low friction entry fairlead that allows the soiled hose to be readily pulled along a straight line path through the cleaner. After entry, the surface of the hose passes through a set of pliant wiping flaps that closely engage the full circumference of the hose. The flaps both wipe dirt and debris from the hose surface as it enters the active cleaning region and contain liquid spray within the active cleaning region.

In the cleaning region, multi-stream jets of high pressure water blast and scour the moving hose's surface. The water is preferably provided from multiple parts in a perforated pipe that surrounds the hose as it passes through the cleaning region. The hose exits the cleaning region through a second set of pliant wiping flaps that contain the liquid spray within the cleaning region.

The active cleaning region, filled with water spray, is maintained at a negative pressure by means of an associated suction system which also sucks out the dirty water and debris. The pliant wiping flaps act as partial pneumatic seals, allowing maintenance of the negative pressure in the cleaning region. This negative pressure also urges water and dirt that may escape from the scouring region back into the low pressure cleaning region.

Finally, the cleaned hose leaves the cleaning device through a second smooth radiused low friction exit fairlead. The fairleads are sufficiently smooth and are appropriately sloped to allow the hose to be pulled through the cleaner by an auxiliary reeling unit onto which the hose is wound after exiting the cleaner. The cleaning device is preferably mounted to a floor of a vehicle directly adjacent the reeling unit. The vehicle also supports a water source and suction unit which are both coupled to the cleaning region.

Carpet cleaning vehicles typically already include the water source, suction unit and reeling unit. Hence, addition of the cleaning device of this invention to such a vehicle provides the entire hose cleaning system. It will be noted that the unit is symmetrical with respect to the direction of hose travel, and the cleaning device works for either direction of hose movement. This symmetrical design feature allows for convenient positioning of the unit, since it can be rotated 180° to allow the auxiliary pressure and suction lines to be on the side adjacent to the auxiliary high pressure water and suction units. This rotation ability provided by the symmetrical design feature, allows for ease of installation of the auxiliary pressure and suction lines and ergometric use.

OBJECTS OF THE INVENTION

Accordingly, a primary object of the present invention is to provide a hose cleaning device which can continuously clean a hose passing through an enclosure and capture debris and cleaning liquid used within the enclosure.

Another object of the present invention is to provide a cleaning device which can be operated by high pressure cleaning liquid and suction equipment contained within a mobile cleaning vehicle such as a carpet cleaning vehicle and which can accommodate passage of hose used by such a mobile vehicle through the device such that the hoses used by the mobile cleaning vehicle can themselves be cleaned by the device of this invention, such as after use and before being rewound onto a reel within the mobile cleaning vehicle.

Another object of the present invention is to provide a hose cleaning device which has a central cleaning chamber through which the hose is passed which has high pressure water spray therein and which utilizes suction within the central cleaning chamber and pliable material adjacent where the hose passes into and out of the central cleaning chamber to contain liquid spray within the central cleaning compartment.

Another object of the present invention is to provide a hose cleaning device which can smoothly feed a hose into and out of the cleaning device without damaging the hose or allowing the hose to become caught within the cleaning device.

Another object of the present invention is to provide a hose cleaning device which can be manufactured with a small footprint from lightweight materials and provide reliable hose cleaning service with multiple repeat uses.

Another object of the present invention is to provide a hose cleaning device which is symmetrical about a hose pathway so that a hose can pass along the hose pathway in either direction with similar hose cleaning results.

Other further objects of the present invention will become apparent from a careful reading of the included drawing figures, the claims and detailed description of the invention.

DESCRIPTION OF THE PREFERRED EMBODIMENT

Figure 1:
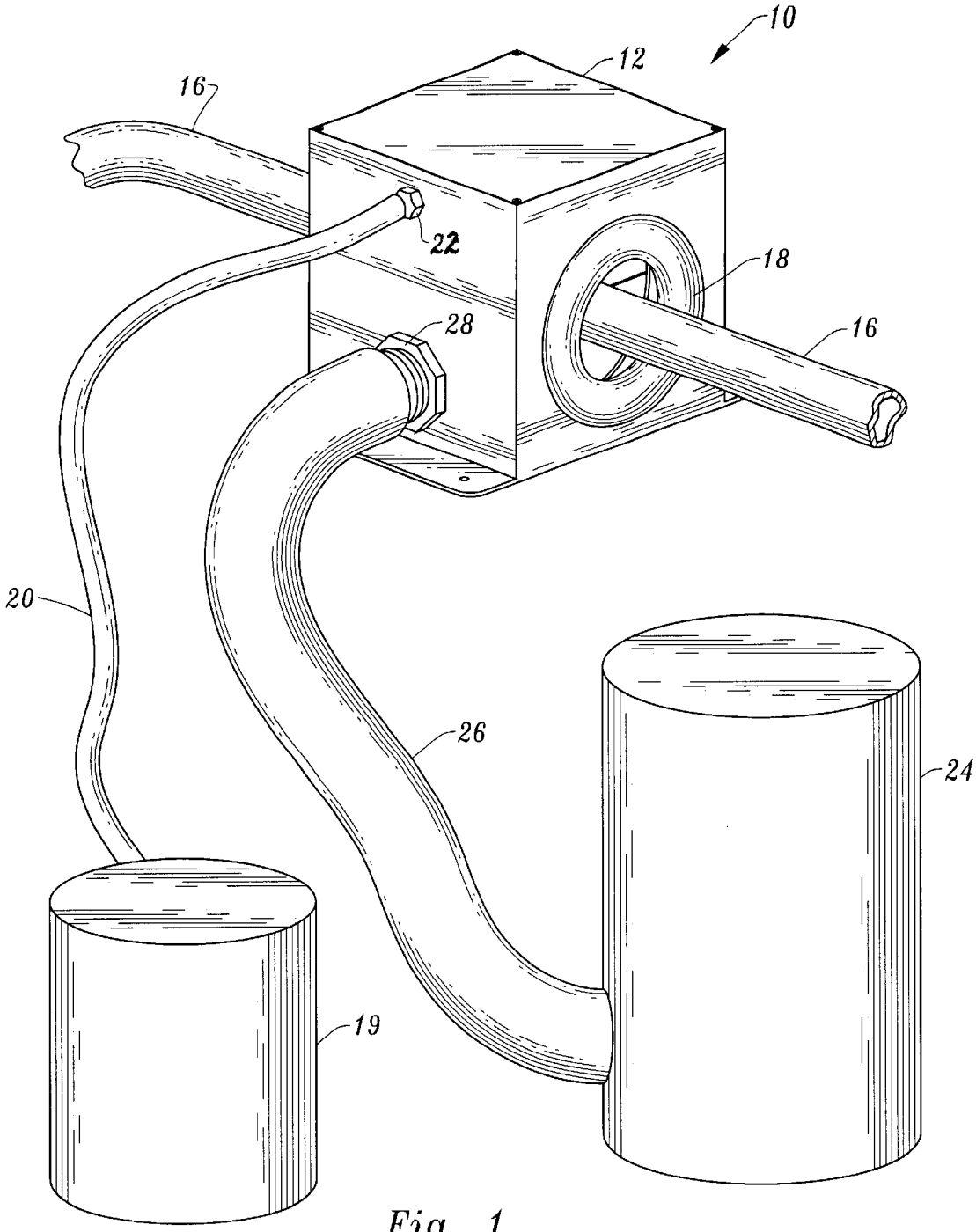
FIG. 1 is a perspective view of the hose cleaning device of the invention interconnected with auxiliary apparatus used in operation of the invention.

Referring to FIG. 1, the hose cleaning device 10 consists of an enclosure 12 having an entry way fairlead 14 (FIG. 2) through which a hose 16 enters the enclosure 12 for cleaning (seen in FIG. 1 is the symmetrically placed exit way fairlead 18 at the opposite end of the enclosure 12, in line with entry way fairlead 14). The fairleads 14, 18 have a rounded cross-section and a smooth surface to allow the hose 16 to be redirected away from a line of hose travel A (FIG. 2) when outside the device 10 and not bind, jam or cause damage to the hose 16 or the device 10. The fairleads 14, 18 also keep the hose 16 close to a center line of the device 10 where the cleaning spray is focused. The hose cleaning device 10 operates with several associated units including a high pressure water source 19 and a suction unit 24 for removing debris and soiled water. The water source 19 is connected to the hose cleaning device 10 by means of a conduit 20 and a connector 22. The suction unit 24 is connected to the enclosure 12 by means of a tube 26 and a connector 28. Details of the roles played by these auxiliary units will be described below.

Figure 2:
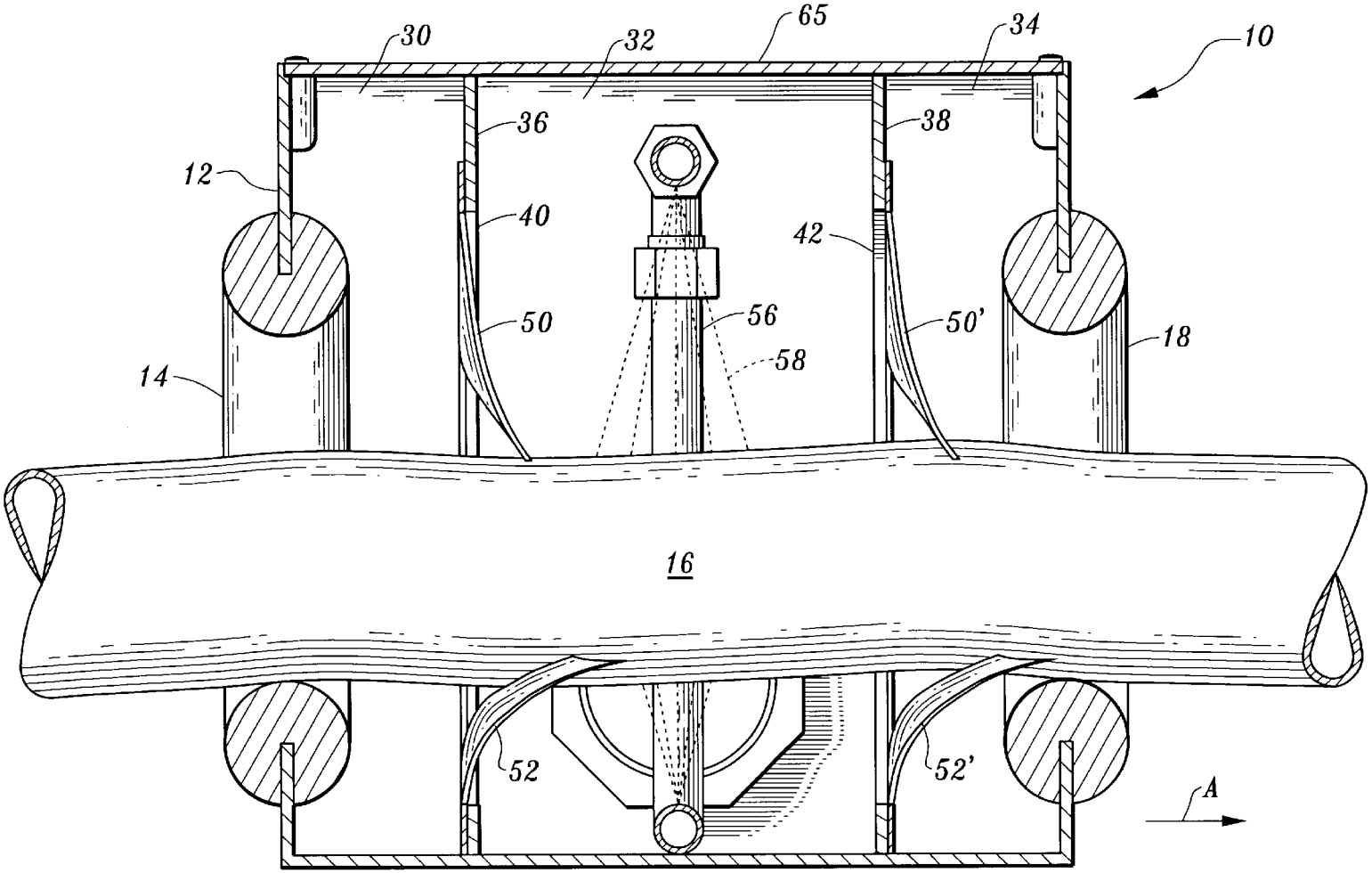
FIG. 2 is a sectional view showing the three interior compartments of the enclosure of the invention.
Figure 3:
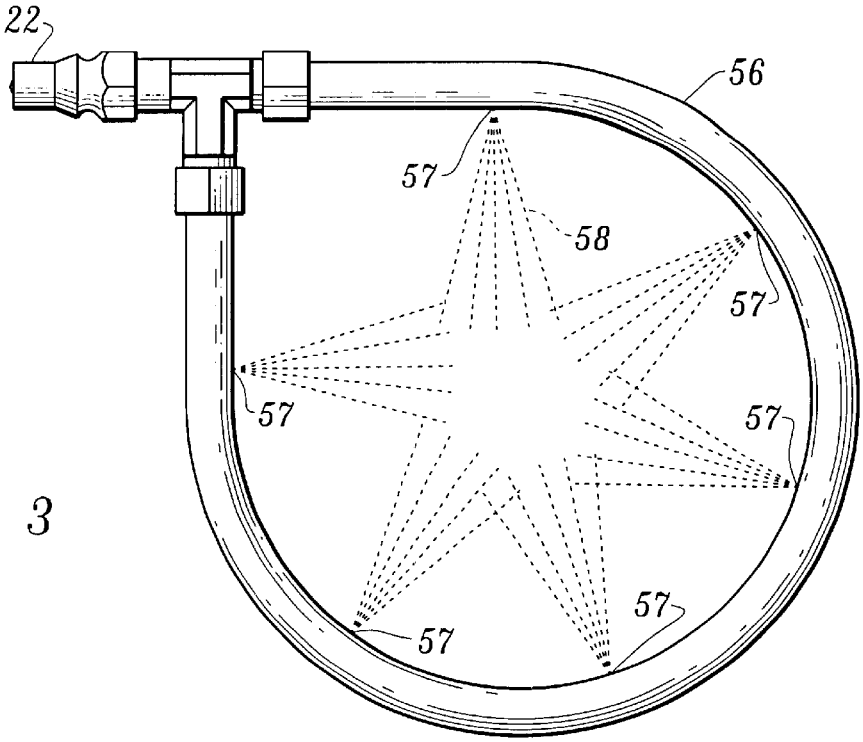
FIG. 3 is an end elevation view of a water spray subsystem utilized in the invention.
Figure 5:
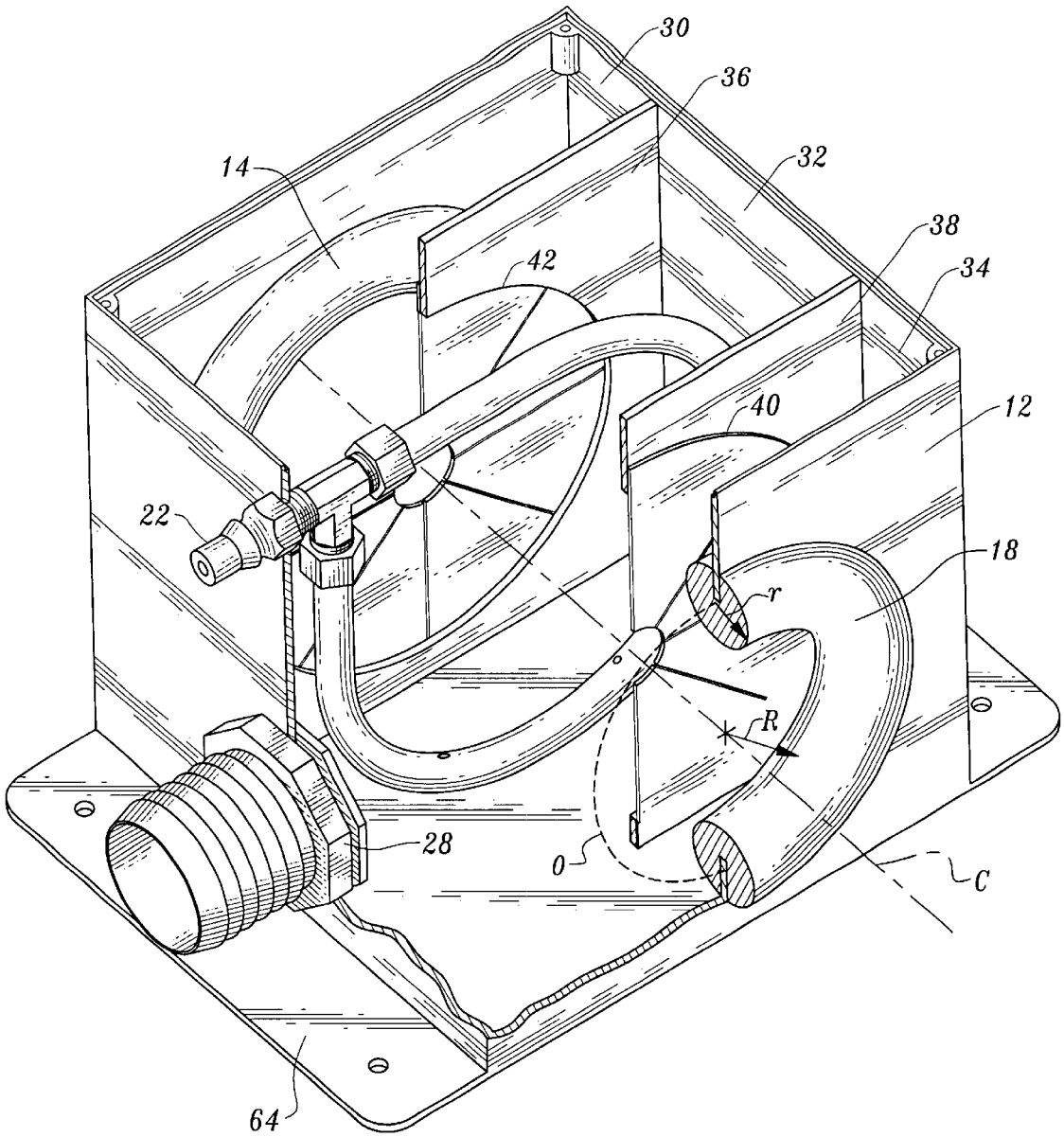
FIG. 5 is a cut away perspective view showing the interior of the enclosure without its cover in place.

As seen in FIG. 2, the enclosure 12 is divided into three adjacent compartments, entry compartment 30, central compartment 32, and exit compartment 34. The entry compartment 30 and the exit compartment 34 act as hose alignment compartments. The hose 16 to be cleaned enters the entry compartment 30 through the entry fairlead 14 that accommodates the easy passage of the hose 16 and any hose connection elements (such as nozzles or fittings) into the cleaning device 10, with the hose 16 following a straight path from the entry fairlead 14 through the cleaning device 10 to the exit fairlead 18. Each fairlead 14, 18 has an opening which surrounds a center line C (FIG. 5) defining a hose travel path through the entry compartment 30, central cleaning compartment 32, and exit compartment 34 of tho device 10. The fairlead preferably has a circular cross-section and is wider than portions of the wall of the entry compartment 30 and exit compartment 34 upon which the fairlead 14, 18 is supported. This enhanced width and curvature allow the hose to smoothly be passed over the smooth surface of the fairlead without binding, catching or causing damage to the hose 16. Hence, the hose 16 can curve sharply away from the line of travel through the device 10 after extending beyond the fairlead 14, 18 and still maintain a substantially linear path for the hose 16 through the device 10. With particular reference to FIG. 5, the circular cross-section and opening of the fairlead 14, 18 of the preferred embodiment is shown. The opening of the fairlead 14, 18 is shown with a circular form having an opening radius R centered on the straight center line C of the device 10. The cross-section shown of the fairlead 14, 18 is also circular with a smoothly radiused surface defined by cross-section radius r centered on a curving origin line O surrounding the straight center line C, the origin line O shown perpendicular to the straight center line C and embedded within the interior of the material forming the fairlead 14, 18. Together the circular opening of opening radius R and the circular cross-section of cross-section radius r of the prefer embodiment give the fairlead 14, 18 shown the shape of a torus, akin to that of a doughnut. As can be seen from FIGS. 1 and 2, the smoothly radiused surface defined by cross-section radius r can abut the hose 16 tangentially and allows the hose 16 to curve away from the straight center line C (FIG. 5) without binding, catching or damaging the hose 16, especially at hose connection elements such as nozzles and fittings in the hose 16. Each alignment compartment 30, 34 includes first sides adjacent the central cleaning compartment 32 and second sides opposite the first sides. The second sides support the fairlead 14, 18 thereon.

Figure 4:
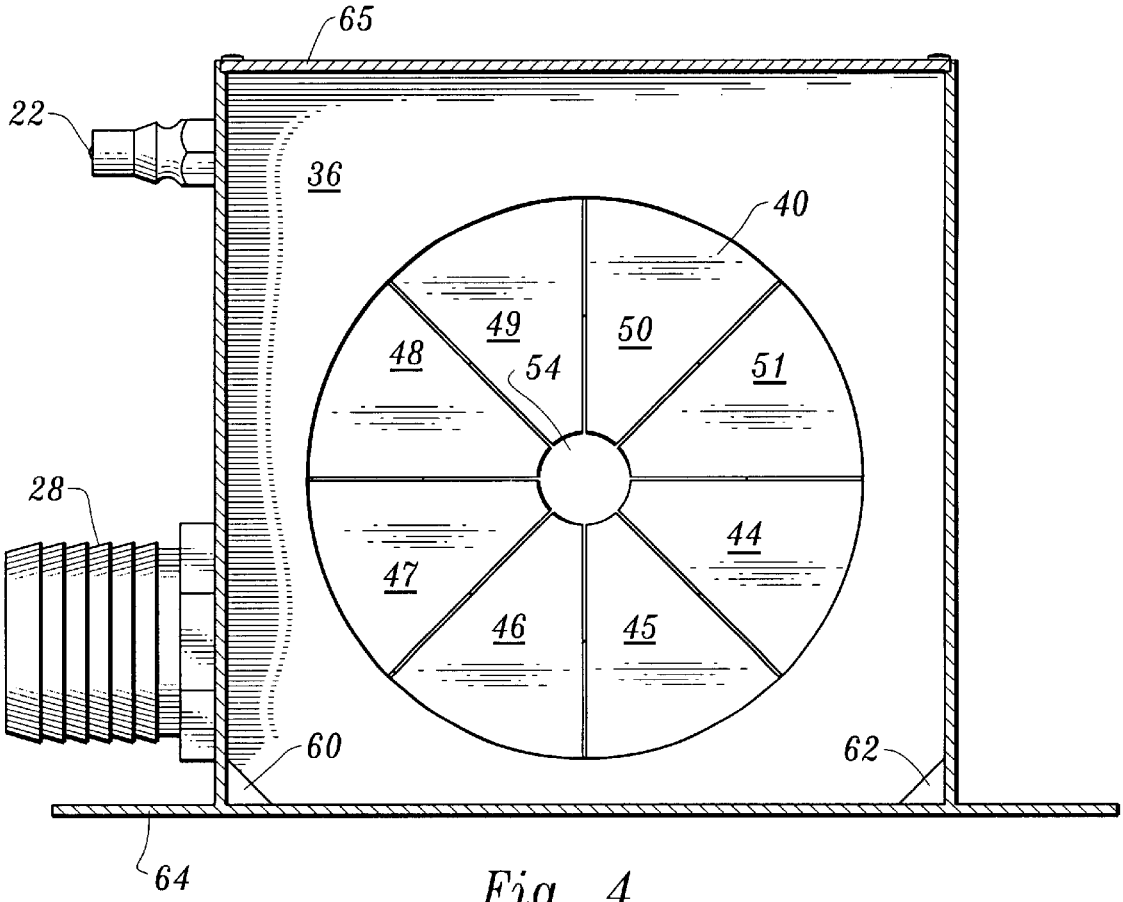
FIG. 4 is an end elevation sectional view of the enclosure, normal to the direction of hose travel, showing the structure of the flaps that separate the compartments of the invention.

Baffles 36, 38 having circular, centrally positioned apertures 40, 42 (FIG. 5) separate the center compartment 32 from the entry compartment 30 and from the exit compartment 34. In FIG. 4, detail of the structure of a baffle, e.g. 36 may be seen; the structure of baffle 38 is identical. Along the circumference of the aperture 40 are mounted a set of substantially pie-shaped pliant, resilient sheets, e.g. 44, 45, 46, 47, 48, 49, 50, 51 positioned edge to edge so the plane of the mounted sheets fills the aperture 40.

At the point corresponding to the center of the aperture 40, the sheets are shaped to form a small circular opening 54 so that the pliant ends of the sheets fit snugly against, and wipe all sides of the hose 16 as it moves along its path into the central compartment 32 (FIG. 2). The pliant sheets, e.g. 44–51 may be rubber, or a high temperature elastomer capable of intimate contact and a swiping motion across the surface of the hose 16 as it passes.

The central compartment 32 defines a preferred form of a cleaning compartment for the device 10. At the midsection of the central compartment 32, perpendicular to the path of the hose 16, is a preferably annularly shaped perforated pipe 56 that showers all sides of the hose 16 with a high pressure hot water spray 58 as the hose 16 transits the central compartment 32. The pipe 56 has multiple outlet ports 57 which approximately face a center line C of the device 10. The ports 57 are sufficiently sized to allow the high pressure hot water to attain a high velocity upon exiting the ports 57. The energy of the water associated wit his velocity enhances the ability of the device 10 to wash dirt/debris off of the hose 16.

The perforated pipe's 56 annular shape may either be circular or polygonal; the hose 16 preferably passing through the center point of its geometry. The hot or cold water is fed to the spray generating perforated pipe 56 from the auxiliary pressurized water supply 19, along the conduit 20 and through the connector 22 on the central compartment 32 external wall. The water supply 19 can be part of a vehicle mounted cleaning system, such as is commonly used for mobile carpet cleaning systems. Such a water supply 19 includes the heater and pump to condition the water for maximum cleaning performance. If desired, cleansers can be added to the water or cleaning fluids other than water can be utilized.

After the hose 16 passes through the high pressure spray 58, which is the primary cleaning mechanism, it moves into the exit compartment through the second baffle 38, identical to baffle 36. The baffle 36 defines an entrance wall to the central cleaning compartment 32 and the baffle 38 defines an exit wall from the central cleaning compartment 32. The pliant sheets e.g 44–51 of the baffles in contacting the hose 16 act as barriers keeping the water in the central compartment 32 from tending to spill into the outer compartments, 30, 34 (in FIG. 2, segments 50' and 52' are shown as components of baffle 38).

The external suction system 24 connected to the central compartment 32 through the tube 26 and wall fitting 28, not only exhausts the soiled spray water ricocheting about the central compartment 32, but provides a negative pressure in the central compartment 32. Since the outer compartments 30, 34 of the enclosure 12 are substantially pneumatically isolated from the central compartment 32 by the closely fitting pliant sheets, e.g. 44–51, as they surround the hose 16, and the outer compartments 30, 34 are at atmospheric pressure, the pressure differential forces any swirling water tending to escape the central compartment 32, back into the central compartment 32 where it will be removed by the suction system 24 through a suction port such as that defined by the wall fitting 28. Additionally, small cuts through the baffles 36, 38 at their lower corners 60, 62 (FIG. 4) act as drain ports to allow water that does seep into the outer alignment compartments 30, 34 to be urged back into the central cleaning compartment 32 due to the pressure differential.

Referring to FIGS. 4 and 5, the base of the enclosure 12 is provided with an integral flange 64. By means of appropriate hardware, flange 64 may be secured to a stationary platform, such as a vehicle floor, to keep the cleaning device 10 solidly in place during operation. Alternatively, a floor of the device can include holes to allow bolting of the enclosure 12 directly to a supporting surface. In such an embodiment the flange 64 might be eliminated. The holes could be formed within enhanced thickness "dimples" to add strength to the floor adjacent the holes and/or to help preclude fluid migration through the holes.

When the device 10 is used to clean a mobile carpet cleaning system hose 16, the device 10 is typically securely mounted on the floor between the hose 16 reeling unit and the hose 16 entrance/exit region on the vehicle. The device 10 has it's suction fitting 28 and water connector 22 coupled to the suction tube 26 and water conduit 20 of the mobile carpet cleaning system so that the system's water supply 19 and suction unit 24 are used to clean the hose 16.

As previously noted, the cleaning device 10 operates bi-directionally independent of hose 16 travel direction. Accordingly, the above description and the drawings which have designated components of the invention as "entry" or "exit" for convenience of explanation, are interchangeable when the direction of hose 16 travel is reversed.

A lid 65 covers the compartments 30, 32, 34. Preferably, the lid is clear to allow an operator to verify that the device 10 is working properly.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. A device for cleaning the surface of a hose moving longitudinally through said device, said device comprising an enclosure, said device further comprising:

a first compartment of said enclosure having a smoothly radiused entry fairlead whereby said hose enters said first compartment with minimum friction;

a first baffle separating said first compartment from a second compartment, said first baffle having a centrally located first aperture therein, said first aperture covered by juxtaposed first segments of pliant planar sheeting mounted along a periphery of said first aperture and extending into said first aperture, whereby a surface of said hose passing through said first aperture is contacted and wiped by said first segments;

said second compartment having an annular liquid sprayer device mounted therein for generating a spray of liquid, whereby when said hose passes through said annular liquid sprayer device liquid is sprayed onto said hose, said liquid supplied from an auxiliary external source of liquid;

said second compartment further having an external connection adapted to be coupled to an external source of suction for exhausting waste liquid and debris from said second compartment;

a second baffle separating said second compartment from a third compartment, said second baffle having a centrally located second aperture therein, said second aperture covered by juxtaposed second segments of pliant planar sheeting mounted along a periphery of said second aperture and extending into said second aperture, whereby said surface of said hose passing through said second aperture is contacted and wiped by said second segments; and said third compartment having a smoothly radiused exit fairlead whereby said hose exits said third compartment with minimum friction.

2. The hose cleaning device of claim 1 wherein said sprayer device is a hot water sprayer.

3. The hose cleaning device of claim 1 wherein said sprayer device generates liquid streams focused at said surface of said hose when said hose passes centrally through said second compartment.

4. The hose cleaning device of claim 1 wherein said pliant planar sheeting is rubber sheeting.

5. The hose cleaning device of claim 1 wherein said pliant planar sheeting is a high temperature elastomer sheeting.

6. The hose cleaning device of claim 1 wherein said central compartment has substantial pneumatic sealing provided by said first and said second baffles, whereby a negative pressure is maintainable in said central compartment when said central compartment is connected to a source of suction during cleaning of said hose.

7. The hose cleaning device of claim 1 wherein said second compartment is connected by ports at the lower portions of said first and said second baffles, whereby waste water in said first and said third compartments flows into said second compartment.

8. The hose cleaning device of claim 1 wherein the base of said enclosure includes at least one bolt receiving hole whereby said device may be secured to a stable platform.

9. The hose cleaning device of claim 1 wherein an imaginary plane through said annular liquid sprayer device perpendicular to said hose travel direction divides said hose cleaning device into two structurally symmetrical units, such that the hose can pass through the device in either direction.

10. A device for cleaning an outer surface of an elongate flexible hose, comprising in combination:

a substantially enclosed cleaning compartment;

a liquid cleaning solution outlet port located within said cleaning compartment, said outlet port coupled to a source of liquid cling solution;

a suction port located within said cleaning compartment, said suction port coupled to a source of pressure less than atmospheric pressure;

a hose alignment compartment having a first side adjacent said cleaning compartment and a second side opposite said first side, both said first side and said second side having openings sufficiently large to allow the hose to pass first through said first side and into said alignment compartment and then through said second side and into said cleaning compartment, said first side opening and said second side opening at least partially aligned to allow the hose to pass through said second side opening and said first side opening along a straight line before entering said cleaning compartment; and at least one fairlead adjacent one of said openings, said fairlead having a curving surface, said curving surface curving about an origin line surrounding a straight center line defining a hose travel path through said cleaning compartment.

11. The device of claim 10 wherein said first side opening includes pliant planar sheeting at least partially covering said first side opening, said first side opening defining an entrance into said cleaning compartment, said cleaning compartment also including an exit opening aligned with said first side opening and said second side opening such that said straight line passing through said second side opening and said first side opening also passes through said exit opening of said cleaning compartment.

12. The device of claim 11 wherein said pliant planar sheeting includes at least three cuts extending radially from a center of said first side opening, such that said planar sheeting is divided into somewhat pie-shaped sections.

13. The device of claim 12 wherein said first side of said alignment compartment includes at least one drain port at a lowermost portion thereof, said drain port allowing liquids to drain from said alignment compartment into said cleaning compartment.

14. The device of claim 10 wherein a second hose alignment compartment similar to said first hose alignment compartment is located adjacent a side of said cleaning compartment opposite said first hose alignment compartment.

15. A device for cleaning an outer surface of an elongate flexible hose, comprising in combination:

a substantially enclosed cleaning compartment;

a liquid cleaning solution outlet port located within said cleaning compartment, said outlet port coupled to a source of liquid cleaning solution;

a suction port located within said cleaning compartment, said suction port coupled to a source of pressure less than atmospheric pressure; and at least one fairlead spaced from said cleaning compartment, said fairlead having a curving surface, said curving surface curving about an origin line surrounded by a straight center line defining a hose travel path through said substantially enclosed cleaning compartment.

16. The device of claim 15 wherein a second fairlead similar to said at least one fairlead is aligned with said linear hose path, said second fairlead located closer to said cleaning compartment exit than to said cleaning compartment entrance.

17. The device of claim 16 wherein a separate enclosed alignment compartment is located between each said fairlead and said cleaning compartment.

18. The device of claim 17 wherein each said fairlead includes a smooth surface which is longer along said linear hose path than walls forming said cleaning compartment entrance and said cleaning compartment exit.

19. A hose cleaning device, comprising in combination:

an enclosure;

a cleaning compartment within said enclosure;

a source of liquid cleaning solution;

a cleaning solution outlet port located within said cleaning compartment and downstream from said source of liquid cleaning solution;

at least two openings into said enclosure; and at least one fairlead adjacent one of said openings, said fairlead having a curving surface, said curving surface curving about an origin line surrounding a straight center line defining a hose travel path through said cleaning compartment.

20. The hose cleaning device of claim 19 wherein said origin line is curved.

21. The hose cleaning device of claim 20 wherein said origin line is circular.

22. The hose cleaning device of claim 21 wherein said origin line is centered about said straight center line.

23. The hose cleaning device of claim 19 wherein said curving surface is defined by a locus of points spaced a constant distance from said origin line.

24. The hose cleaning device of claim 23 wherein said curving surface is located at least partially inside said enclosure and at least partially outside said enclosure.

25. The hose cleaning device of claim 24 wherein said curving surface forms a complete circle surrounding said origin line.

26. The hose cleaning device of claim 25 wherein said origin line is circular and said origin line is centered about said straight center line.

27. The hose cleaning device of claim 19 wherein a suction port is located within said cleaning compartment, said suction port coupled to a source of pressure less than atmospheric pressure.

28. The hose cleaning device of claim 19 wherein each of said at least two openings includes a fairlead adjacent thereto.

29. The hose cleaning device of claim 28 wherein each said fairlead has a common shape.

30. The hose cleaning device of claim 19 wherein said at least two openings into said enclosure are located in walls of said enclosure spaced from said cleaning compartment.

31. The hose cleaning device of claim 30 wherein said walls of said enclosure having said openings therein are oriented parallel to each other.

* * * * *